United States Patent [19]

Inoue

[11] Patent Number: 4,697,813

[45] Date of Patent: Oct. 6, 1987

[54] GOLF CLUB

[76] Inventor: Shinsuke Inoue, 26-2, Ohaza Shiwa, Haki-cho, Asakura-gun, Fukuoka-ken 838-14, Japan

[21] Appl. No.: 845,100

[22] Filed: Mar. 27, 1986

[30] Foreign Application Priority Data

Apr. 1, 1985 [JP] Japan ..... 60-49053[U]

[51] Int. Cl.[4] ..... A63B 53/04; A63B 53/02

[52] U.S. Cl. ..... 273/167 H; 273/171; 273/80.2; 273/80 C

[58] Field of Search ..... 273/167 H, 169, 167 F, 273/171, 170, 172, 167 E, 80.2–80.9, 80 C

[56] References Cited

U.S. PATENT DOCUMENTS 1,582,836 4/1926 Link ..... 273/167 H 4,417,731 11/1983 Yamada ..... 273/167 H

FOREIGN PATENT DOCUMENTS 398643 9/1933 United Kingdom ..... 273/167 H

*Primary Examiner*—George J. Marlo

*Attorney, Agent, or Firm*—Flynn, Thiel, Boutell & Tanis

[57] ABSTRACT

A golf club comprises a tubular member folded back from the middle thereof toward the interior thereof, an outer wall part as providing an outer shape of a golf club head, and an inner wall part integrally formed with the outer wall part at the folded portion which portion is formed on the back surface part of the golf club head, the tip of the inner wall being integrally provided with the tip of the club shaft. The golf club can be set very deeply in the center of gravity thereof since impact energy can be transmitted through the club shaft to a grip end. Said golf club can be greatly made light-weight owing to the use of the hollow tubular member for the club head.

12 Claims, 7 Drawing Figures

GOLF CLUB

BACKGROUND OF THE INVENTION

1. Field of the Invention

The present invention relates to a golf club, and more particularly to an improved golf club head.

2. Description of the Prior Art

Current golf clubs have been improved variously up to now in their performances. Each of these golf clubs has its head integrally attached to a tip of its shaft. With a golf club head more increased in depth rather than in face width as well as more deepend in the center of gravity, it can then send a golf ball flying to a greater distance.

However, such a golf club head can not more increase its depth than the width of its face does in view of its specification. This makes it impossible for the golf club head to be improved in its dimentional outline.

Accordingly, improvements of prior golf clubs were almost for material qualities thereof.

The prior club heads thus have a shorter distance to its back weight portion to which impact energy is concentrated and so its center of gravity made shallower. Accordingly, the prior golf clubs are disadvantageously limited in development of its capability to properly send a ball to a greater distance.

Moreover, golf clubs currently have an inclination to be lightened in weights thereof, but to do this only an improvement mainly in material qualities thereof has merely been performed.

SUMMARY OF THE INVENTION

It is an object of the present invention to provide a golf club profitably employing a hollow tubular member integrally connecting a face of a club head and a shaft with each other for thereby enabling impact energy to be transmitted through the shaft to a grip end and the center of gravity to be set very deeply.

A second object of the present invention is to provide a golf club capable of greatly reducing its own weight owing to the use of the hollow tubular material for itself.

To achieve the above objects, a golf club haas a hollow tubular member folded back continuously from the middle thereof toward the interior thereof, an outer wall part as providing an outer shape of a golf club head, and an inner wall part integrally formed with the outer wall part at the folded portion which portion is formed on the back surface part of the golf club head, the tip of the inner wall being integrally provided with the tip of the club shaft.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
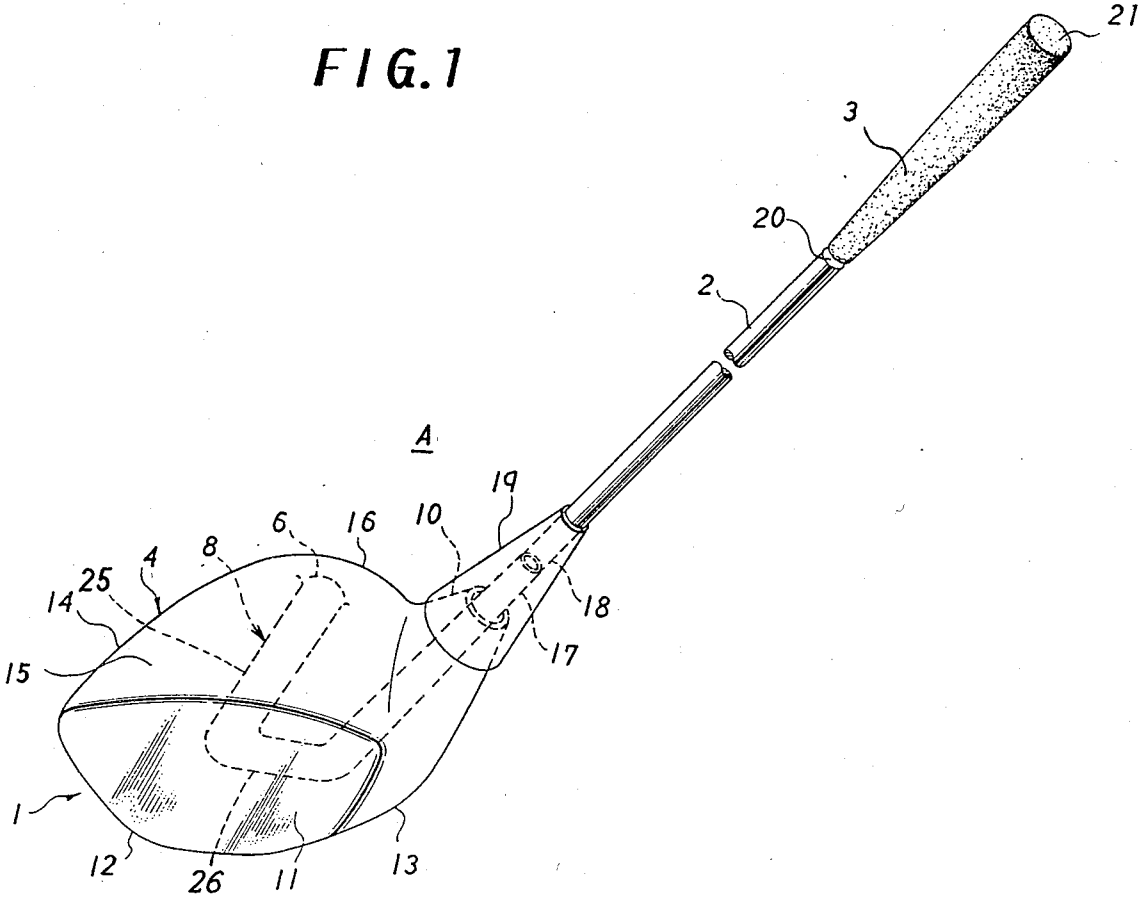
FIG. 1 is a perspective view illustrating a golf club being a wood according to the present invention.
Figure 2:
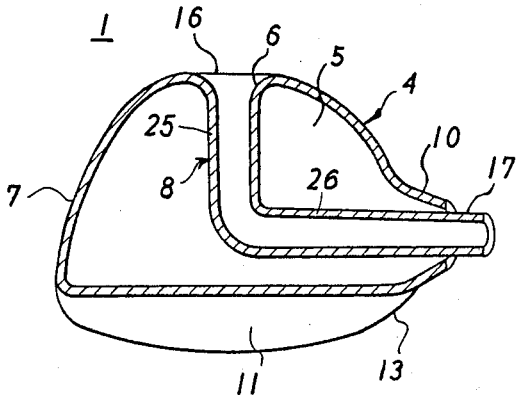
FIG. 2 is a cross sectional view of a club head of the golf club of FIG. 1.

As shown in FIGS. 1 and 2, a golf club A corresponding in configuration to a wood comprises a club head 1, a club shaft 2, and a grip 3.

The club head 1 is a hollow shell-like structure with an outer wall 7 and an inner wall 8, both being integrally and continuously joined at a folded portion 6 made by folding back a hollow tubular member 4 from the middle thereof toward the interior 5 thereof.

The outer wall 7 is formed as a hollow shell according to the outer appearance of the club head 1, and comprising a neck 10, a face 11, a sole 12, a heel 13, a toe 14, a head top surface 15, and a head back surface 16.

The inner wall 8 is formed as a hollow small-diameter tube and includes a first tubular portion 25 which projects forwardly from the folded portion 6 into the interior of the outer shell 7. This portion 25, at a location close to but spaced rearwardly from the face 11, is bent sidewardly to define a second tubular portion 26. This portion 26 projects sidewardly through a limited extent and is bent upwardly to define a third tubular portion 17 which projects out through the neck 10. This portion 17 is gradually made narrower toward the neck 10, and is connected integrally with a tip end 18 of the club shaft 2.

The club shaft 2 has step portions at appropriate locations thereof and a grip 3 at the end thereof.

Moreover, designated at 19 is a shaft collar, 20 is a grip trim, and 21 is a grip end.

Accordingly, the golf club A of the present invention has the club head 1 formed into a hollow double-wall structure composed of the outer wall 7 and the inner wall 8 made by folding back the hollow tubular member 4 from the middle thereof toward the tube interior 5. In addition, the outer wall 7 is constructed to provide the outer appearance of the club head while the inner wall 8 is adapted to extend to the neck 10 provided on the outer wall 7 and integrally connected with the club shaft 2. Thus the golf club is integrally and continuously formed from the face 11 to the club shaft 2, and thereby has the center of gravity shifted to the grip 3 of the club shaft 2 and thus enables the center of gravity to be deepened.

Thus, the golf club A can send a golf ball flying to a greater distance since it can effectively transmit impact energy to the grip end 21 of the club shaft 2.

Moreover, since the club head 1 is formed with the hollow tubular member 4, it can be made so as to be of light weight.

Although the embodiment of the golf club according to the present invention was described above with reference to the accompanying drawings, the present invention is not limited to the embodiment and can be subjected to various modification without departing from the scope of the present invention.

Figure 3:
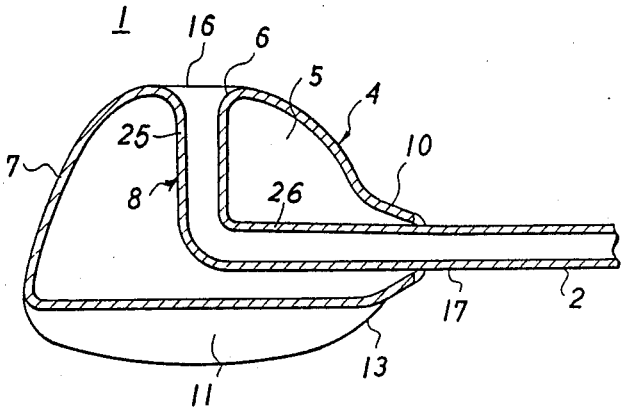
FIG. 3 is a cross sectional view of another embodiment of a golf club according to the present invention whose club head has an inner wall integrally formed with a club head.

For example, as shown in FIG. 3, a case is included in the present invention, wherein the inner tubular wall 8 which is integrally formed with the club shaft 2 as described above may be adapted to extend outward to define the club shaft 2. This arrangement can furthermore transmit the impact energy.

Figure 4:
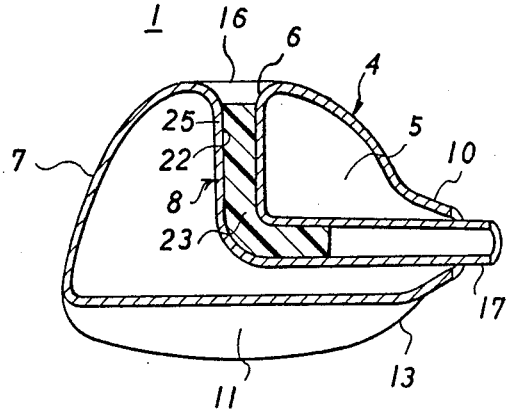
FIG. 4 is a cross sectional view of a further another embodiment of a golf club having a club head whose tubular interior is filled with a member such as expandable urethane.
Figure 5:
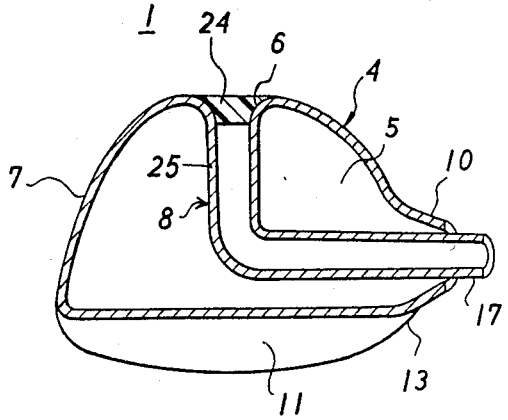
FIG. 5 is a cross sectional view of a still another embodiment of a golf club having a club head whose folded tubular interior is hermetically sealed.

Moreover, as shown in FIG. 4, the tube interior 22 may be filled with a member such as an expanded urethane 23, etc., for preventing foreign matter from entering thereinto or, as shown in FIG. 5, the opening defined at the folded portion 6 may be hermetically sealed by a plug member 24.

Figure 6:
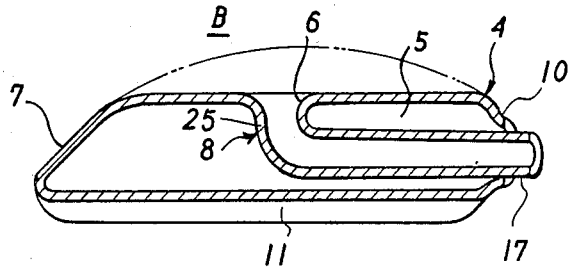
FIG. 6 is a cross sectional view of a further another embodiment of a golf club being an iron.
Figure 7:
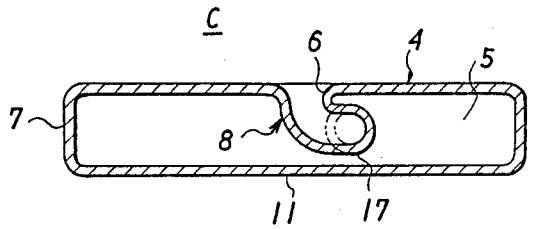
FIG. 7 is a cross sectional view of a still further another embodiment of a golf club applicable as a putter.

Furthermore, the club head of the present invention is applicable, not only for forming a wood as described above, but also for forming all clubs such as an iron B shown in FIG. 6 and a putter C shown in FIG. 7.

With the golf club according to the present invention, as described above, the hollow tubular member is folded back from the middle thereof in the inside of the hollow tube, the outer wall and the inner tubular wall being continuously joined at the folded portion, the outer wall being constructed into the outer configuration of the club head, the folded portion being formed on the back surface of the club head to integrally connect the tip of the inner tubular wall with the tip of the club shaft. Consequently, the golf club is integrally and continuously formed through the hollow tubular member from the face to the shaft, and thereby impact energy is transmitted through the shaft to the grip end, and thus can set the center of gravity very deeply. In such a way, the center of gravity of the club head can be shifted to the grip end and thereby the impact energy can be transmitted to the grip end of the club shaft without any loss. As a result, the head is structured as to much more increase the depth of the head than the face width and thus can send a golf ball flying to a greater distance.

Moreover, since the club head is formed with the hollow tubular member, it can be made light weight for use as an ultra-light weight golf club.

Although certain preferred embodiments have been shown and described, it should be understood that many changes and modifications may be made therein without departing from the scope of the appended claims.

What is claimed is:

1. In a golf club having an elongated club shaft provided with a club head fixed to the lower end of the shaft, comprising the improvement wherein:

said club head being defined by a thin shell-like outer wall having a configuration which approximately corresponds to the outer configuration of the club head and defines at least a face and a back surface spaced rearwardly from the face, the outer wall also defining a neck portion projecting sidewardly of the head for cooperation with the shaft;

said club head also including an inner tubular wall which is fixed to said back surface substantially at the middle thereof and projects forwardly therefrom into the interior of the club head, said inner tubular wall at a location spaced forwardly from said back surface being bent sidewardly to define a tubular tip portion which is oriented generally toward the neck portion of said outer wall, said tubular tip portion being directly fixedly and rigidly attached to said shaft.

2. A golf club according to claim 1, wherein said tubular tip portion projects outwardly through said outer wall at said neck portion thereof.

3. A golf club according to claim 2, wherein said tip portion is of a gradually tapered configuration as it projects toward and through the neck portion.

4. A golf club according to claim 2, wherein said tip portion extends outwardly through said outer wall and integrally defines said club shaft.

5. A golf club according to claim 1, wherein said inner tubular wall at its rearward end is integrally joined to the back surface of said outer wall by a smoothly rounded corner which surrounds and defines in said back surface an opening which communicates with the interior of said inner tubular wall.

6. A golf club according to claim 5, including material disposed within and filling the interior of said inner tubular wall.

7. A golf club according to claim 5, including a plug member disposed within said opening directly adjacent said back surface for sealingly closing the interior of said inner tubular wall.

8. A golf club according to claim 1, wherein the configuration of said outer wall corresponds to a club head conventinally known as a wood.

9. A golf club according to claim 1, wherein said outer wall has a configuration corresponding to a club head conventionally known as an iron.

10. A golf club according to claim 1, wherein said outer wall is defined by a hollow tubular member which defines the outer configuration of the club head and projects inwardly to define the back surface and then projects inwardly into itself from the middle of the back surface toward its interior so as to define said inner tubular wall, said inner tubular wall being integrally and continuously formed with said outer wall.

11. In a golf club having an elongated shaft provided with a club head fixed to the lower end thereof and a grip on the upper end thereof, comprising the improvement wherein:

said club head is defined by an outer shell-like wall formed by an outer tubular member which defines side surfaces of the club head and which projects inwardly to define a back surface of the club head, and a hollow tubular inner wall which is integral with said outer tubular member and projects from the middle of the back surface inwardly into the interior of the club head, said inner tubular wall and said outer tubular member being integrally and continuously joined by a smoothly curved annular portion disposed substantially at said back surface, and said inner tubular wall at a location spaced from said back surface being fixedly connected with the lower end of said shaft.

12. A golf club according to claim 1, wherein said inner tubular wall includes a tubular tip portion which is disposed within the interior of said club head and is oriented sidewardly so as to be directly fixedly connected to said club shaft.

* * * * *

UNITED STATES PATENT AND TRADEMARK OFFICE

CERTIFICATE OF CORRECTION

PATENT NO. : 4 697 813

DATED : October 6, 1987

INVENTOR(S) : Shinsuke Inoue

It is certified that error appears in the above-identified patent and that said Letters Patent is hereby corrected as shown below:

Column 4, line 59; change "1" to ---11---

Signed and Sealed this

Eighth Day of March, 1988

*Attest:*

DONALD J. QUIGG

*Attesting Officer*

*Commissioner of Patents and Trademarks*